US008758280B2

(12) United States Patent
Wallace

(10) Patent No.: US 8,758,280 B2
(45) Date of Patent: Jun. 24, 2014

(54) ATHLETIC MASSAGE DEVICE

(76) Inventor: Carey M Wallace, Coldspring, TX (US)

( * ) Notice: Subject to any disclaimer, the term of this patent is extended or adjusted under 35 U.S.C. 154(b) by 665 days.

(21) Appl. No.: 12/986,585

(22) Filed: Jan. 7, 2011

(65) Prior Publication Data

US 2011/0172573 A1 Jul. 14, 2011

Related U.S. Application Data

(60) Provisional application No. 61/293,340, filed on Jan. 8, 2010.

(51) Int. Cl.
*A61H 1/00* (2006.01)
*A61H 7/00* (2006.01)

(52) U.S. Cl.
USPC ..... 601/46; 601/112; 601/134

(58) Field of Classification Search
USPC ..... 601/46, 49, 57, 58, 60, 61, 63, 65, 67, 601/69, 70, 72, 73, 80, 84, 86, 87, 94, 97, 601/98, 99, 101, 102, 103, 107, 110, 111, 601/112, 113, 134
See application file for complete search history.

(56) References Cited

U.S. PATENT DOCUMENTS 4,878,489 A * 11/1989 Kamayachi ..... 601/72
5,123,406 A * 6/1992 Masuda ..... 601/72
5,577,995 A * 11/1996 Walker et al. ..... 601/120
6,039,679 A * 3/2000 Yu ..... 601/73

* cited by examiner

*Primary Examiner* — Quang D Thanh
(74) *Attorney, Agent, or Firm* — Nick A Nichols, Jr.

(57) ABSTRACT

An athletic massage device is described with improved pressure absorption and distribution, along with methods for using the same. The athletic massage device may comprise one or more layers of pliant material, which allow a user improved control over how to adjust applied pressure. In some embodiments, devices are provided with a deep core construction with a pliant outer perimeter. A hard spine may house a motor and rechargeable battery to create vibrations, which may be adjustable. An inner core layer of a pliant material may overlay the spine. An outer surface layer of a more pliant material may overlay the inner core. Protrusions from the spine may extend into the inner core layer to improve pressure or energy transfer. Embodiments may be provided in the form of balls, massage sticks, rolling pins, or dumbbells.

16 Claims, 4 Drawing Sheets

ATHLETIC MASSAGE DEVICE

CROSS-REFERENCE TO RELATED APPLICATIONS

This application claims benefit of U.S. provisional patent application Ser. No. 61/293,340, filed Jan. 8, 2010, which is herein incorporated by reference.

BACKGROUND OF THE INVENTION

1. Field of the Invention

Embodiments of the present invention generally relate to configurations of a massage device to enhance muscle recovery after athletic exertion.

2. Description of the Related Art

When training or competing in sports, athletes undergo strenuous muscle exertions. Vigorous muscular activity results in buildup of lactic acid and other metabolites in muscle fibers. In addition, repetitive active contraction and passive stretching of muscle fibers during vigorous exercise may result in micro-trauma to the muscle fibers. Metabolic overload and micro-trauma result in tightening and contraction of muscles. This, in turn, impedes athletic performance.

Massage therapy expedites muscle recovery after vigorous exercise by activating certain vascular and neuromuscular pathways. Injured and exhausted muscles send pain messages to the spinal cord via small unmyelinated nerve fibers. Spinal reflexes further perpetuate and maintain this unwanted muscle contraction through motor efferents as a protective mechanism against further trauma. In accordance with the gate control theory of pain (See Jessell T M, Kelly D D: Pain and Analgesia, in Kandel E R, Schwartz J H, Jessell T M (eds): Principles of Neural Science, Third Edition, New York, Elsevier, 1991, pp 385-399, incorporated by reference herein), somatosensory stimulation and vibration during massage activate large myelinated nerve fibers that interrupt these unwanted reflexes by virtue of modulating the neurotransmitters in the spinal cord. As the motor commands from the spinal cord are suppressed, the contracted muscles are allowed to relax. This muscular relaxation improves vascular flow, which in turn allows better delivery of oxygen and nutrients and better washout of metabolites, thus expediting muscular recovery.

They key to the efficacy of athletic massage is sensory stimulation that is not perceived as painful by sensory receptors, thus preferentially activating the large myelinated nerve fibers that suppress the motor input to the muscles. While skilled massage therapists continuously adjust massage pressure to achieve this end, athletic massage equipment lacks the feedback mechanisms that would allow for such adjustments.

Existing massage equipment is typically made of a single material, such as wood or plastic, applying fixed pressure through a single hard surface at the point where the equipment contacts the skin. Furthermore, although some massage devices incorporate vibration stimulation, the vibration energy that is transferred through this single hard interface cannot be readily modulated. As such, the effectiveness of such equipment is limited.

Accordingly, there is a need for massage equipment that allows for easily adjusting the amount of pressure that is put on the body. There is further a need for a tool that athletes can use by themselves. Additionally, there is a need for massage equipment that better distributes energy and pressure to various body parts and that may be easily adjustable. Moreover, there is a need for massage tools that allow greater versatility of use within a single device.

SUMMARY OF THE INVENTION

Embodiments disclosed herein generally provide for athletic massage devices, with improved pressure absorption and distribution, and methods for using the same. The athletic massage devices may comprise one or more layers of pliant material, which allow a user improved control over how to adjust applied pressure or vibration energy. In some embodiments, devices are provided with a deep core construction with a pliant outer perimeter. The core may comprise a spine that houses a motor and rechargeable battery to create vibrations. Vibrations may also be adjustable. The spine may be made from a hard, light weight material such as aluminum or plastic or composites. One or more layers of one or more types of pliable material may substantially surround a portion of the spine. Layers may vary in pliability or in hardness. The spine(s) may have extensions such as fins or spokes which protrude through at least one of the pliable layers.

For example, there may be an outer surface layer of a soft foam for making contact with the skin. Memory foam is a preferred material for the outer surface layer. The outer surface layer may substantially surround an inner core layer of a denser foam or rubbery material, which in turn may surround a hard spine. The spine may house an adjustable motor which allows a user to create adjustable vibrations. The spine may also have protrusions that extend radially from the spine into the inner core layer, so that the inner core may absorb and distribute vibration energy. Protrusions may be provided in different embodiments, such as fins or spokes.

Accordingly, the outer surface layer may be applied softly to the skin over a muscle with light pressure or light vibration. By applying additional pressure to the device, a user may apply pressure to the muscle from denser foam beneath the outer layer. Applying additional pressure to the device may allow for firmer pressure to be applied from the hard spine, while at the same time cushioning the muscle with one or more of the more pliant layers. The amount of cushioning may also be adjusted, such as by applying pressure to regions where one or more protrusions extend from the spine into the dense inner core. Thus, embodiments allow a user to have a large amount of control over pressure and/or vibration energy. Further, adjustable pressure may be applied over a wider range of areas with much more control than was previously available with other devices. Additionally, embodiments may be made in various configurations, such as balls, sticks, rolling pins or dumbbells.

In one embodiment, an athletic massage device is provided for applying adjustable pressure, the device comprising: a spine made from a hard material, wherein the spine at least partially surrounds an interior space; an inner core layer made from a material that is more pliant than the spine, wherein the inner core layer at least partially surrounds the spine; and an outer surface layer made from a material that is more pliant than the inner core layer, wherein the outer surface layer at least partially surrounds the inner core layer. The athletic massage device may further comprise: at least one rechargeable battery; at least one vibrating motor, housed at least partially within the interior space of the spine; and at least one electrical connection. The electrical connection may be a female receptor adapted for electrical connection with a charging station. The athletic massage may further comprise a control interface to vary the level of vibration.

Additionally, the athletic massage device may comprise protrusions that extend radially from the spine into the inner core layer. The protrusions may also extend substantially through the inner core layer. Moreover, the pliant material of the inner core layer may comprise either a dense foam or rubbery material, and the pliant material of the outer surface layer may comprise a soft memory foam.

Embodiments of the athletic massage device may be provided in various shapes. In some embodiments, the device may be substantially shaped like a ball, or a dumbbell, or a massage stick. The massage stick may also be configured as a rolling pin. For example, the athletic massage device may comprise a plurality of hand grips, wherein at least a portion of the massage stick is adapted to roll between the hand grips.

In another embodiment, an athletic massage device is provided for applying adjustable pressure, the device comprising: a first hand grip for a user to hold near a first end of the device; a second hand grip for a user to hold near a second end of the device; and a plurality of substantially cylindrical massage knuckles positioned between the first and second hand grips, each knuckle comprising: a spine made from a hard material, wherein the spine at least partially surrounds an interior space; and at least a first layer of pliant material that at least partially surrounds the spine. Additionally, each of the plurality of knuckles may rotate. Moreover, the spines of each of the plurality of knuckles may be connected to form a single piece that serves as a common spine for the plurality of knuckles. Further, each of the plurality of knuckles further may comprise a second layer of pliant material that at least partially surrounds the first layer of pliant material and that is more pliant that the first layer of pliant material. Each of the plurality of knuckles may also comprise protrusions that extend radially from the spine into at least the first layer of pliant material.

In additional embodiments, the athletic massage device for applying adjustable pressure may also comprise at least one rechargeable battery; at least one vibrating motor, housed at least partially within the interior space of one or more of the spines; and at least one electrical connection. The rechargeable battery may be housed at least partially within the second hand grip, and/or the electrical connection may be a female receptor in the second hand grip adapted for electrical connection with a charging station. Further, the athletic massage device may comprise a second vibrating motor, and/or a control interface to adjust the vibration level provided to the device from the combination of the first and second vibrating motors.

A method is also provided for applying adjustable pressure from an athletic massage device, the method comprising: providing an athletic massage device comprising a hard spine, a pliant inner core layer overlaying the spine, an outer surface layer overlaying the inner core layer that is more pliant than the inner core layer, and at least one vibrating motor within the device; applying the athletic massage device to a muscle; applying light pressure or light vibration to the muscle from the more pliant outer core layer; applying increased pressure or vibration to the muscle from the pliant inner core layer; and adjusting the vibration energy applied to the muscle from the vibrating motor. The method may further comprise distributing vibration energy evenly to the pliant inner core layer through protrusions from the spine that extend radially through at least a portion of the inner core layer.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended figures. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention discussed herein generally provide athletic massage devices, with one or more layers of pliant material, and methods for using the same. Embodiments provide for massage devices with improved pressure absorption and distribution, which may also allow a user improved control over how to adjust applied pressure. In some embodiments, devices are provided with a deep core construction with a pliant outer perimeter.

Figure 1:
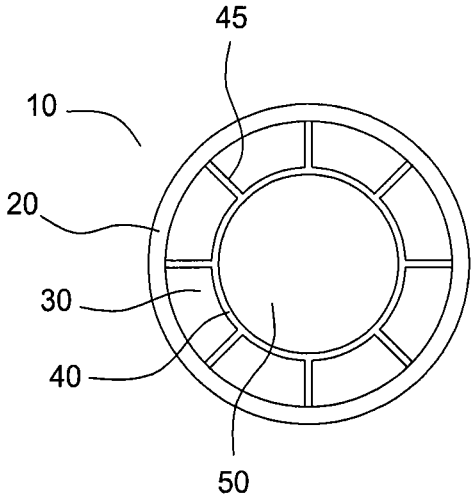
FIG. 1 depicts a cross-sectional view of a massage device according to one embodiment of the invention.
Figure 2:
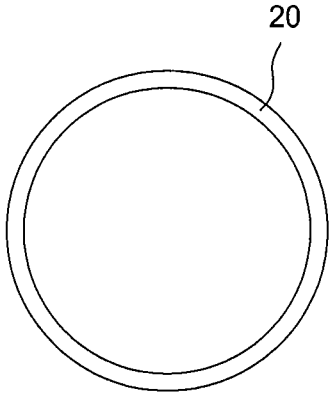
FIG. 2 depicts a cross-section of an outer surface layer according to some embodiments.
Figure 3:
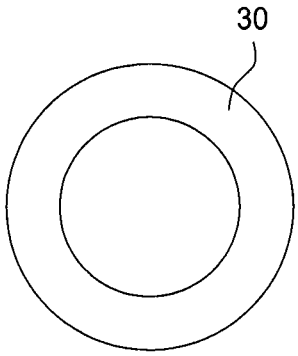
FIG. 3 depicts a cross-section of an inner core layer according to some embodiments.
Figure 4:
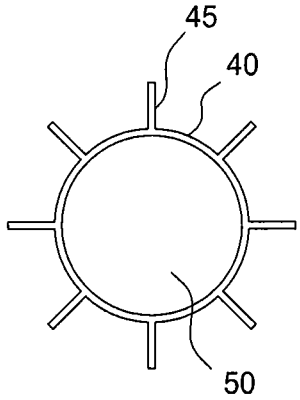
FIG. 4 depicts a cross-section of a spine according to some embodiments.

FIG. 1 provides a cross-sectional view of one embodiment of the invention. FIG. 1 illustrates an athletic massage device in a ball arrangement. FIGS. 2-4 provide cross-sectional views of possible components used in the device of FIG. 1. It is to be understood that embodiments discussed herein may be applied in other configurations, such as in massage sticks or rolling pins or dumbbells or other arrangements.

In FIG. 1, athletic massage device 10 comprises a deep core construction with layers of varying pliability. At the core of the device is a spine 40, which preferably comprises a hard, light weight material such as aluminum or plastic or composites. Spine 40 may surround an interior space 50, which may serve as a housing for components that perform desired mechanical or electrical operations. For example, spine 40 may house one more batteries, motors, wiring systems or controls for creating vibrations. Vibrations may be variable.

In the embodiment shown in FIG. 1, an inner core 30 overlays spine 40, and comprises a material with more pliability than spine 40. For example, a dense foam or rubbery material may be used for the inner core 30. An outer surface 20 overlays the inner core 30, and comprises a material with even more pliability. For example, outer surface 20 may comprise a soft material such as memory foam for soft contact with skin.

Spine 40 may also have protrusions 45, such as fins or spokes, which extend into one or more of the surrounding layers. Protrusions 45 may allow vibration energy to be transferred more efficiently or more evenly from the spine 40 into the softer layers surrounding it. In FIG. 1, the protrusions 45 are pictured as extending through the inner core 20 to contact the outer surface 30. Other embodiments may provide protrusions 45 extending partially into one or more of the layers. Protrusions 45 may also be used to determine or adjust how much vibration energy is transferred to different layers. For example, as shown in FIG. 1, the number and the length of protrusions 45 may determine how much energy is transferred into the inner core 30. The protrusions 45 may then only contact outer surface 20 without extending into the layer so that less energy is transferred to this layer. Accordingly, a user may apply more or less vibration energy for a given setting by applying more or less pressure to the device 10. Protrusions 45 may be made from the same material as the spine 40, with the same hardness, or from different materials as desired. Protrusions 45 may also serve other purposes, such as anchoring the surrounding layers in position, or providing additional firmness in the device.

FIGS. 2-4 illustrate cross-sections of possible components of massage device 10, viewed separately. FIG. 2 illustrates outer surface 20 as a continuous layer. FIG. 3 illustrates inner core 30 as a continuous layer. FIG. 40 illustrates spine 40 with protrusions 45 that may extend at partially into one or more of the surrounding layers. Other embodiments may provide layers that are not continuous. For example, in FIG. 1, if protrusions 45 comprise fins, inner core 30 could be provided as material between the respective fins 45. Further, even though FIG. 1 illustrates eight protrusions 45 evenly spaced in a cross-sectional view, there may be more or less protrusions 45 provided over the surface of spine 40, and the protrusions 45 may be spaced in other desired configurations. Other embodiments may employ more or less layers, or alternatively, may employ one or more layers of varying density in accordance with the invention.

Embodiments in rounds shapes, such as a ball, may be used in troubled areas that are curved like in shoulders or knees to help release the tissue or to help muscles get blood flow moving more freely. Balls may be designed in various sizes. Some preferred sizes may have a diameter of about 4-inches, 6-inches, 8-inches or 10-inches for use on various body types and various places. The outer surface 20 may have a thickness less than that of the inner core 30. For example, the inner core 30 may have a thickness of about 2.5 to 3 inches. The outer surface 20 may have a thickness less than about 1 inch, such as about 0.25 inches.

Figure 5:
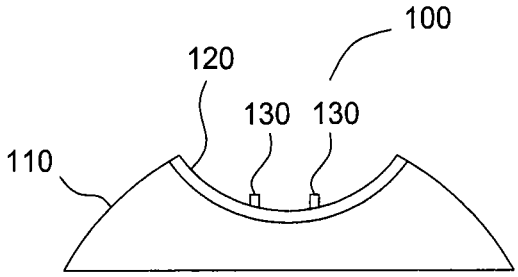
FIG. 5 depicts a charging station adapted to receive a round-shaped device, according to some embodiments.

Additionally, wire connectors may go through the device 10, or ports may be provided, for connecting a rechargeable battery in the device 10 to a power source. For example, a female receptor may be provided in the device 10, or on its surface, for connection to a charging station. One embodiment of a charging station 100 is shown in FIG. 5. The charging station 100 has a base 110 with an upper surface 120 adapted to receive the device 10. Connectors 130 may be adapted to provide an electrical connection to device 10. In the embodiment shown in FIG. 5, connectors 130 are pictured as male connectors for insertion into device 10. Charging station 100 may be designed as an electrical plug without the base 110, for plugging into a wall outlet.

Embodiments disclosed herein provide improved pressure absorption and distribution over a large surface area. A user is also afforded greater control over how to adjust applied pressure and energy. For example, when device 10 is used to massage a muscle, a user may initially apply soft pressure so that the softer outer surface 20 applies pressure to the skin. Accordingly, the muscle may initially be massaged more gently with light pressure or light vibration. Further, outer surface 20 may provide a softer contact surface for comfort. As the muscle begins to relax, the user may apply additional pressure so that pressure is exerted on the muscle from denser or harder material deeper within device 10. For example, the user may apply deeper pressure or more vibration energy from the inner core 30. Additionally, the user may apply even deeper pressure or vibration energy from the hard spine 40 or the protrusions 45. Alternatively, the user may start by applying more energy to move a muscle or muscle group that is tighter, and adjust applied pressure or energy as desired or depending on the muscle's response. Outer surface 20 may also provide cushioning to the muscle while firmer pressure is applied from deeper layers in the device 10. The amount of cushioning may also be adjusted, such as by applying pressure to regions where one or more fins protrude through the dense foam inner core. Thus, embodiments allow a user to have a large amount of control over pressure and/or vibration energy. Moreover, the thicknesses and pliability of the different layers in device 10 may be selected for a desired level of applied pressure, energy transfer or comfort.

Figure 6:
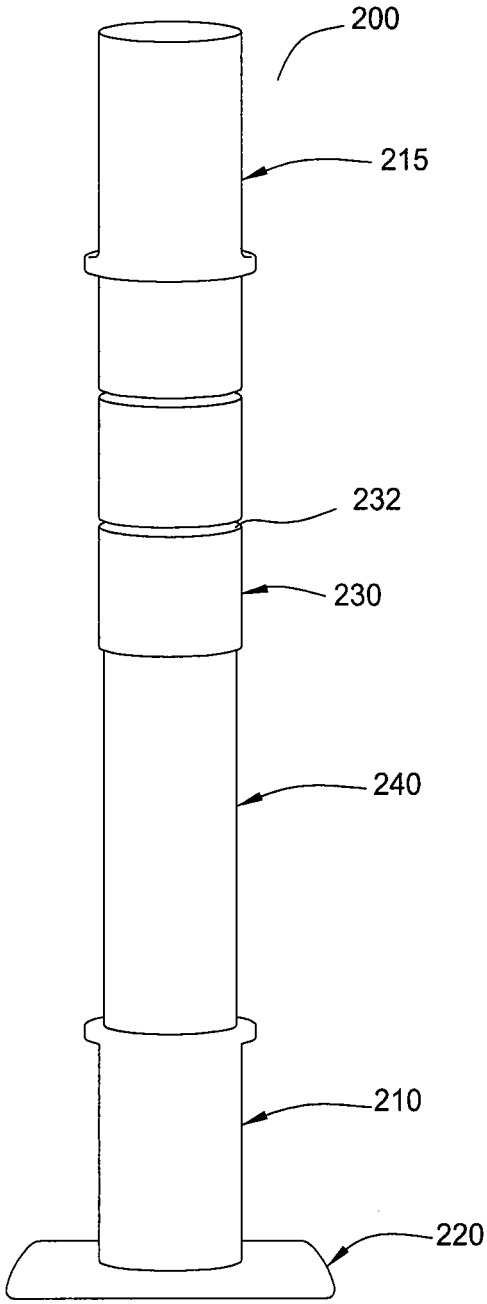
FIG. 6 depicts a cross-view of a massage stick, according to another embodiment of the invention.
Figure 7:
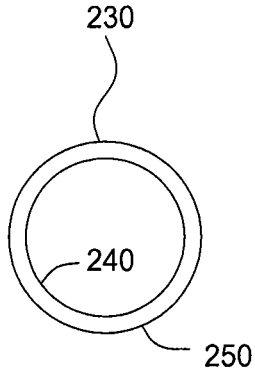
FIG. 7 depicts a cross-section of a possible embodiment of knuckle.

FIG. 6 shows a cross view of a massage stick 200, according to another embodiment of the invention. Massage stick 200 may also be configured as a rolling pin device, such as with rotatable components. The massage stick 200 may have hand grips 210 and 215. A docking station 220 may be adapted to receive the device, in this case, on the side of hand grip 210. One or more sections of pliant material referred to as a knuckle 230 may be provided between hand grips 210 and 215. Knuckles 230 may also be referred to as joints or bushings. Knuckles 230 may be configured, such as described above for FIG. 1, with one or more layers of pliant material over a hard spine. FIG. 7 shows a cross-section of a possible embodiment of knuckle 230. In FIG. 7, a layer of pliant material 250 overlays spine 240. As discussed previously in connection with FIG. 1, there more be one or more layers of pliant material 250 overlaying the spine 240, and the layers may vary in pliability. The layer of pliant material 250 may also comprise thin memory foam that serves as a bumper between the knuckle 230 and a person's skin.

In the embodiment shown in FIG. 6, multiple knuckles 230 share a single spine 240. If a rolling pin arrangement is used, the spine 240 may rotate between the hand grips 210 and 215. Alternatively, knuckles 230 may individually rotate about the spine 240, or else have separate spines so that each knuckle 230 may individually rotate. Although FIG. 6 illustrates a portion of the spine without knuckles, it is to be understood that knuckles 230 may cover the spine 240 from end-to-end. Knuckles 230 may also be spaced apart slightly by a gap 232.

Figure 8:
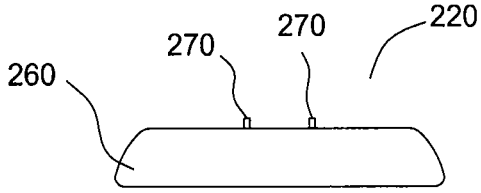
FIG. 8 depicts a charging station adapted to receive a massage stick device.

Additionally, one or more motors (not shown) may be placed inside the device, such as underneath the handgrips 210 and/or 215. One or more motors could also be placed inside the spine 240 or knuckles 230. Handgrips 210 and 215, spine 240 and/or knuckles 230 may provide housing for other components as well. The one or more motors may allow for adjustable levels of vibration, or for turning vibration features on and off. Control features may be provided on either one or both of handgrips 210 and/or 215. Motor vibration may be controlled by a rotary feature on handgrip 210 and/or 215. For example, vibration levels may be changed by rotating the handgrip or a portion of the handgrip. Buttons or switches could also be provided, such as a thumb engagement. Docking station 220 may also serve as a charging station. FIG. 8 depicts a charging station 220 adapted to receive massage stick 200. Charging station 220 comprises a base 260 and connectors 270 for electrical connection to rechargeable batteries inside massage stick 200.

In one embodiment, massage stick 200 is provided with a foam covered roller, and is about 36 inches long and 6 inches in diameter. Such a device may be may be especially useful for working on a large muscle, such as a pulled hamstring, which may require a lot of pressure and/or energy to help release it when it is retracted. The need for assistance is even greater when a trainer is working on an athlete that may be very large, such as a football lineman. In such situations, massage stick 200 can be used to roll out the muscle. Further, adjustable vibrations may be applied to stimulate the muscle and to allow it to be relaxed with less energy.

Figure 9:
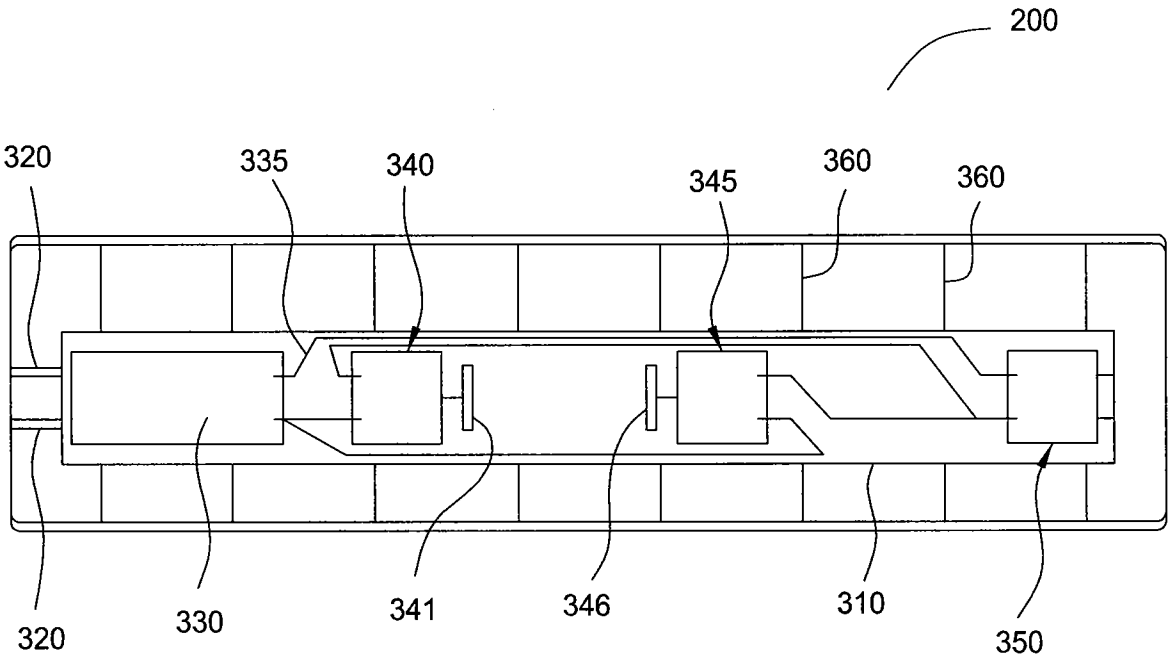
FIG. 9 provides an internal, cross-section view of possible components in a massage stick device, according to some embodiments.

FIG. 9 provides an internal, cross-section view of possible components in massage stick 200, according to some embodiments. Motor housing 310 is provided inside massage stick 200. Motor housing 310 may comprise the spine 240 and/or portions of handgrips 210 and 215, as discussed above. At one end, electrical connections 320 are provided to one or more rechargeable batteries 330. Rechargeable battery 330 is electrically connected by wires 335 to one or more motor vibrators 340 and 345 and a control unit 350. Control unit 350 may comprise an off-on switch, a speed control or vibration control, or other desired functions. Motor vibrators 340 and 345 have impellers 341 and 346, respectively, which are used to create vibrations.

In one embodiment, motor vibrators 340 and 345 comprise 25-volt motors. More or less motors may be used in the embodiments discussed herein. In the embodiment shown in FIG. 9, fins 360 are provided to redistribute energy more evenly through the pliant layers of the massage stick 200. As discussed above for FIG. 1, fins 360 may distribute energy to a hard foam layer or inner core, which may be overlaid with a soft memory foam outer surface layer. When more than one motor vibrator is used, the different motors may be set to different layers of vibration. For example, a first motor may be set for a deep vibration, and a second motor may be set for a mild vibration. Preferably, the motor with milder vibration may be positioned closer to the center of the device for better energy distribution.

Figure 10:
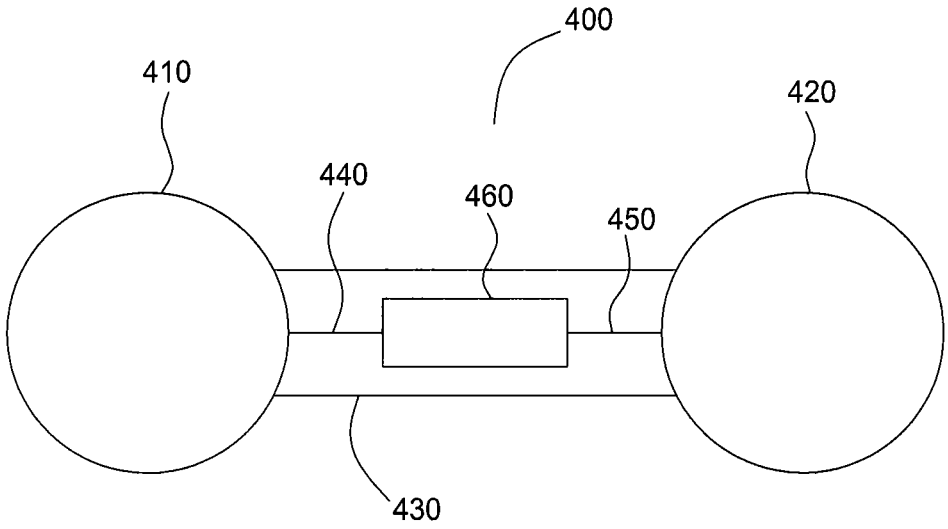
FIG. 10 depicts a plan view of a barbell message device, according to another embodiment of the invention.

FIG. 10 provides an embodiment of a massage device 400 in a barbell arrangement. Massage balls 410 and 420 may be provided according to the embodiments discussed herein. Center piece 430 may join massage balls 410 and 420 together. Center piece 430 may also contain a motor housing 460 for components that create vibrations in the massage device 400. Center piece 430 may also serve as a handle or have user controls. Ports and/or charging connections may also be provided in the center piece 430. Vibrations may be created in massage ball 410 and/or massage ball 420. Connection pieces 440 and 450 may provide electrical connections. Alternatively, vibrations may be transferred mechanically from the center piece 430 to massage balls 410 and 420 through connection pieces 440 and 450, respectively. Massage balls 410 and 420 and center piece 430 may also be constructed out of a dense foam. The dense foam may surround a spine. Similar to other embodiments, components may be housed in a spine. Additionally, a spine may be used inside massage balls 410 and 420 to transfer vibration energy from connection pieces 440 and 450, respectively. If components such as motors are housed in center piece 430, spines in the massage balls could comprise a solid piece instead of a hollow interior. Alternatively, components, such as motors, may be housed inside the dense foam without a spine. Such embodiments could be made by pouring material into a mold. Other embodiments discussed herein may be made similarly. The dense foam may also be layered with a softer memory foam if desirable. Protrusions from the spine, such as fins or spokes, may also be utilized in massage balls 410 and/or 420 for energy or pressure transfer or adjustment.

The barbell kind of massage tool depicted in FIG. 10 may be especially useful in doing pressure-point work down a human spine. Having a barbell configuration may allow a person to do self-therapy laying on the floor by doing pressure-point work right down their spine. Thus, it may be preferable to configure the device so that it does not roll or to use the device in a manner so that it does not roll excessively.

While the foregoing is directed to embodiments of the present invention, other and further embodiments of the invention may be devised without departing from the basic scope thereof, and the scope thereof is determined by the claims that follow.

What is claimed is:

1. An athletic massage device for applying adjustable pressure, the device comprising:
- a rigid spine, wherein the spine at least partially surrounds an interior space;
- an inner core layer of a first pliant material having a first density overlaying the spine;
- an outer surface layer of a second pliant material having a second density overlaying the inner core layer; and
- a plurality of protrusions extending radially from the spine into the inner core layer.

2. The athletic massage device of claim 1, further comprising:
- at least one rechargeable battery;
- at least one vibrating motor, housed at least partially within the interior space of the spine; and
- at least one electrical connection.

3. The athletic massage device of claim 2, wherein the electrical connection is a female receptor adapted for electrical connection with a charging station.

4. The athletic massage device of claim 3, further comprising a control interface to vary the level of vibration.

5. The athletic massage device of claim 1, wherein the protrusions extend substantially through the inner core layer.

6. The athletic massage device of claims 1 wherein the first pliant material comprises either a dense foam or rubbery material, and wherein the second pliant material comprises a soft memory foam.

7. The athletic massage device of claim 2, wherein the device is substantially shaped like a ball.

8. The athletic massage device of claim 2, wherein the device is substantially shaped like a dumbbell.

9. The athletic massage device of claim 2, wherein the device is substantially shaped like a massage stick.

10. The athletic massage device of claim 9, further comprising a plurality of hand grips, wherein at least a portion of the massage stick is adapted to roll between the hand grips.

11. An athletic massage device for applying adjustable pressure, the device comprising:
- an elongate substantially cylindrical spine, wherein the cylindrical spine at least partially surrounds an interior space;
- a first hand grip secured proximate a first distal end of the cylindrical spine; a second hand grip secured proximate a second distal end of the cylindrical spine; and
- a plurality of substantially cylindrical massage knuckles rotatably mounted on the cylindrical spine between the first and second hand grips, each knuckle comprising:
  - a rigid spine, wherein the rigid spine at least partially surrounds an interior space;
  - a first layer of pliant material having a first density overlaying the rigid spine;
  - a second layer of pliant material having a second density overlaying the first layer of pliant material; and
- wherein each of the plurality of knuckles further includes protrusions extending radially from the rigid spine into at least the first layer of pliant material.

12. The athletic massage device of claim 11, wherein each of the plurality of knuckles independently rotate about the cylindrical spine.

13. The athletic massage device of claim 12, further comprising:

at least one rechargeable battery;

at least one vibrating motor, housed at least partially within the interior space the cylindrical spine; and at least one electrical connection.

14. The athletic massage device of claim 13, wherein the rechargeable battery is housed at least partially within the second hand grip; and wherein the electrical connection is a female receptor in the second hand grip adapted for electrical connection with a charging station.

15. The athletic massage device of claim 14, further comprising:

a second vibrating motor; and a control interface to adjust the vibration level provided to the device from the combination of the first and second vibrating motors.

16. A method of applying adjustable pressure from an athletic massage device, the method comprising:

providing an athletic massage device comprising a hollow rigid spine, an inner layer of pliant material having a first density overlaying the hollow rigid spine, an outer surface layer of pliant material having a second density overlaying the inner layer of pliant material, and at least one vibrating motor mounted within the hollow rigid spine;

applying the athletic massage device to a muscle;

applying light pressure or light vibration energy to the muscle;

applying increased pressure or vibration energy to the muscle;

distributing vibration energy evenly to the inner layer of pliant material through protrusions extending radially from the hollow rigid spine through at least a portion of the inner layer of pliant material; and adjusting the vibration energy applied to the muscle.

* * * * *